US005357705A

United States Patent [19]

Stengel

[11] Patent Number: 5,357,705

[45] Date of Patent: Oct. 25, 1994

[54] GUN CLEANING ROD

[76] Inventor: David J. Stengel, 2626 Broadway, Redwood City, Calif. 94063

[21] Appl. No.: 22,334

[22] Filed: Feb. 24, 1993

[51] Int. Cl.[5] ..... F14A 29/02

[52] U.S. Cl. ..... 42/95; 15/104.165

[58] Field of Search ..... 42/90, 95; 15/104.16, 15/104.165

[56] References Cited

U.S. PATENT DOCUMENTS

| | | | |
|---|---|---|---|
| 852,748 | 5/1907 | True | 15/104.165 |
| 1,532,223 | 4/1925 | Belding | 42/95 |
| 1,547,072 | 7/1925 | Silcott | 15/104.165 |
| 2,544,847 | 3/1951 | Malesky | 15/104.165 |
| 2,897,525 | 8/1959 | Goodwin et al. | 42/95 |
| 3,286,293 | 11/1966 | Eckert | 42/95 |
| 4,222,142 | 9/1980 | DiProspero | 15/104.165 |
| 4,399,627 | 8/1983 | Malesky et al. | 15/104.16 |
| 4,674,218 | 6/1987 | Bottomley | 42/95 |
| 4,803,792 | 2/1989 | Brown et al. | 42/95 |
| 4,866,871 | 9/1989 | Rivers | 42/95 |
| 4,899,415 | 2/1990 | Wheeler | 15/104.05 |
| 5,010,675 | 4/1991 | Selleck | 42/70.11 |
| 5,038,509 | 8/1991 | Stephan | 42/95 |
| 5,233,124 | 8/1993 | Peterson | 42/95 |

*Primary Examiner*—David Brown
*Attorney, Agent, or Firm*—James J. Leary

[57] ABSTRACT

An adjustable gun cleaning device which protects the firing pin of the gun from damage during cleaning. The invention has a double-ended cleaning rod with a cylindrical wire brush on one end and an eye loop for holding a cloth swab on the other end. In between the two ends of the rod is mounted a cylindrical handle which slides over the cleaning rod. A thumb screw on the handle can be used to lock the handle in different positions along the cleaning rod. The movable handle serves as an adjustable shoulder stop to limit the forward motion of the cleaning rod during gun cleaning. Because it is adjustable, the handle can be repositioned for use as a safety stop with different length gun barrels. The end of the handle nearest the wire brush is hollowed out to form a cylindrical cavity so that it can also serve as a protective storage cover for the wire brush when not in use.

5 Claims, 3 Drawing Sheets

GUN CLEANING ROD

FIELD OF THE INVENTION

This invention relates to firearm cleaning devices. More specifically, it relates to a gun cleaning rod for cleaning a revolver which protects the firing pin of the revolver from damage.

BACKGROUND OF THE INVENTION

Proper care and maintenance of rifles, shotguns and pistols requires that the gun barrels be kept free of obstruction, cleaned and oiled. The best time to clean and lubricate a firearm is as soon as possible after it has been used. This minimizes fouling and the corrosive effects of gases produced during firing.

The typical gun cleaning device is a rod which has interchangeable tips, including a wire brush for cleaning the gun barrel and a cleaning patch holder or sponge for oiling the barrel after cleaning. During the cleaning, it is very important that the firing pin of the gun be protected from damage. The recommended method is to disassemble and remove the firing mechanism before cleaning. However, this is not always practical. With some firearms, notably revolvers, automatic firearms and many antique or classic firearms, the firing mechanisms are complex or difficult to disassemble. It is also inconvenient to disassemble the firing mechanism of a firearm in the field for cleaning immediately after use. It is, therefore, desirable to provide a device for cleaning the bore of a gun that protects the firing pin of the gun from damage without the necessity of disassembling or removing the firing mechanism.

SUMMARY OF THE INVENTION

It is an objective of the present invention to provide a gun cleaning device which protects the firing pin of the gun from damage so that the bore of the gun can be cleaned without removing the firing mechanism. It is also an objective to provide a gun cleaning device which is adjustable for use in cleaning different lengths of gun barrels with the same degree of protection to the firing pin.

It is another objective of the invention to provide a gun cleaning tool which combines the functions of a wire brush and a patch holder in one convenient, easy to use unit. It is yet another objective of the invention to provide the gun cleaning device with a handle which can be used to hold the device when it is used as a wire brush or as a patch holder and which provides a protective cover for the wire brush during use or storage.

To meet these objectives, the present invention takes the form of a double-ended gun cleaning rod which has a cylindrical wire brush on one end and an eye loop for holding a cloth patch in the other end. In between the two ends of the rod is mounted a cylindrical handle. The handle has a through-bore which is sized to slide over the cleaning rod. A thumb screw on the handle can be used to lock the handle in different positions along the cleaning rod. The end of the handle nearest the wire brush is hollowed out to form a cylindrical cavity with a length and width large enough to accommodate the cylindrical wire brush.

The movable handle of the cleaning device serves three different purposes. It serves as a handle for the cleaning rod that can be positioned to use with the wire brush or with the patch holder end of the rod. The hollow cavity of the handle serves as a protective cover for the wire brush when that end of the rod is not in use. Most importantly, the movable handle serves as an adjustable shoulder stop to limit the forward motion of the cleaning rod during gun cleaning. Whether the wire brush end or the patch holder end is in use, the handle can be positioned and locked in place so that the rod will not contact or damage the firing pin at the limit of the forward motion. Because it is adjustable, the handle can be repositioned for use as a safety stop with different length gun barrels. Other objects and advantages of the invention will be apparent to those skilled in the art upon reading and understanding the following description of the invention along with the accompanying drawings.

DETAILED DESCRIPTION OF THE INVENTION

Figure 1:
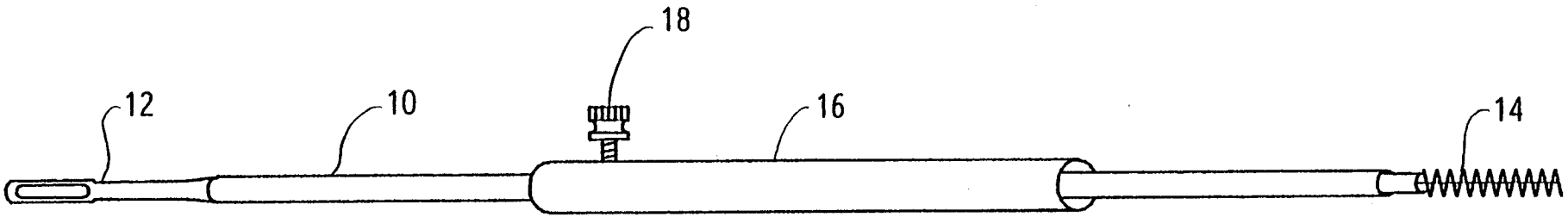
FIG. 1 is a perspective drawing of the gun cleaning device.

FIG. 1 shows a perspective drawing of a gun cleaning device made in accordance with the present invention. The device has a double-ended cleaning rod 10 which has a cleaning patch holder 12 on one end and a cylindrical wire brush 14 on the other end. Preferably the ends of the cleaning rod 10 are internally threaded so that the patch holder 12 and the wire brush 14 are removable and replaceable. This allows these tools to be replaced when worn, and it allows the device to be used with different sizes of brushes or different styles of cleaning patches, swabs or sponges.

In the current embodiment, which is designed for use with revolvers and other pistols, the rod 10 is a twelve inch long anodized aluminum rod, one-quarter inch in diameter. For use with rifles and shotguns, the twelve inch rod 10 can be replaced with a longer rod or with a segmented rod made from short threaded sections which screw together to form a longer cleaning rod. It will be understood that other materials such as brass, steel or plastic may also be used for making the cleaning rod 10.

Preferably, the patch holder 12 is an eye loop molded of a tough, resilient plastic, such as nylon. The eye loop of the patch holder 12 is sized to hold a patch or strip of cloth that is used to oil the inside of the gun barrel. Other types of cleaning tips which hold an oiling swab or sponge may be used in place of the patch holder shown.

Figure 2:
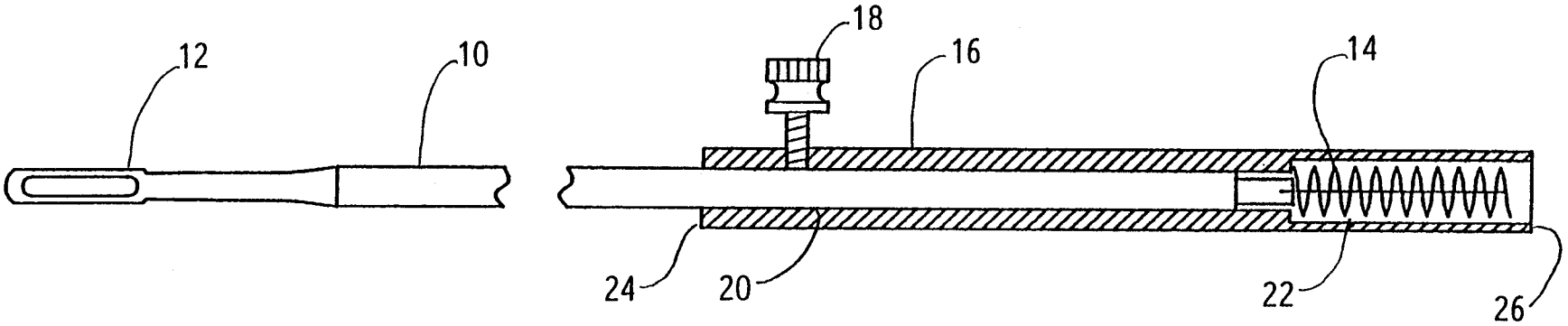
FIG. 2 shows the gun cleaning device in the storage position with the handle shown in cross section.

The handle 16 is slidably mounted on the cleaning rod 10 intermediate the two ends with the patch holder 12 and the wire brush 14. As shown in FIG. 2, the handle 16 has a through bore 20 which is sized to slide smoothly over the cleaning rod 10. A thumb screw type of locking screw 18 can be used to lock the handle 16 to the cleaning rod 10 at any position along the rod. If desired, other types of locking mechanisms, such as a cam lock or a compression collar, may be used in place of the locking screw 18. The handle 16 has a cylindrical cavity 22 within the end nearest the wire brush 14. This hollow cylindrical cavity 22 has a length and diameter large enough to accommodate the wire brush 14 so that the handle 16 can be used to cover and protect the wire brush 14 when the patch holder 12 is being used or when the device is in storage. If desired, a similar hollow cavity can be formed on the other end of the handle 16 in order to cover the patch holder 12 while the wire brush 14 is being used.

The two ends of the handle 16 form shoulders 24, 26 which serve as adjustable safety stops to limit the forward travel of the cleaning rod 10 during the cleaning operation. The effective length of the cleaning rod 10 can be adjusted by correctly positioning the handle 16 along the cleaning rod 10 and locking it in place with the locking screw 18.

In the presently preferred embodiment, the handle 16 is made from anodized aluminum and is cylindrical in shape with a knurled surface for easy gripping. The handle could, of course, be made in different materials, such as steel, brass, plastic or a fiber reinforced plastic composite. The handle could also be made in different geometries. For example, the handle could be molded with an ergonomic hand grip, as long as the key functional elements are preserved: the sliding fit with the cleaning rod, a locking mechanism, the hollow cavity for protecting the wire brush and the two shoulder stops.

OPERATIONAL DESCRIPTION

Figure 3:
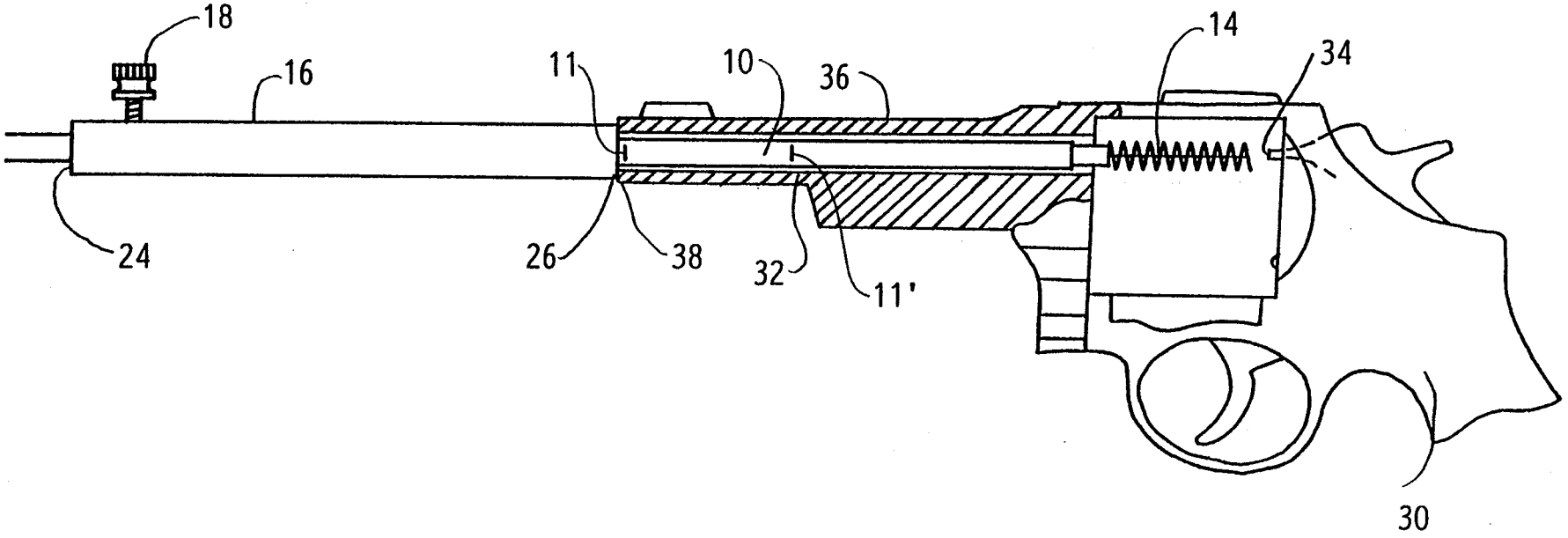
FIG. 3 is a cutaway view of the gun cleaning device being used for cleaning a standard revolver.
Figure 4:
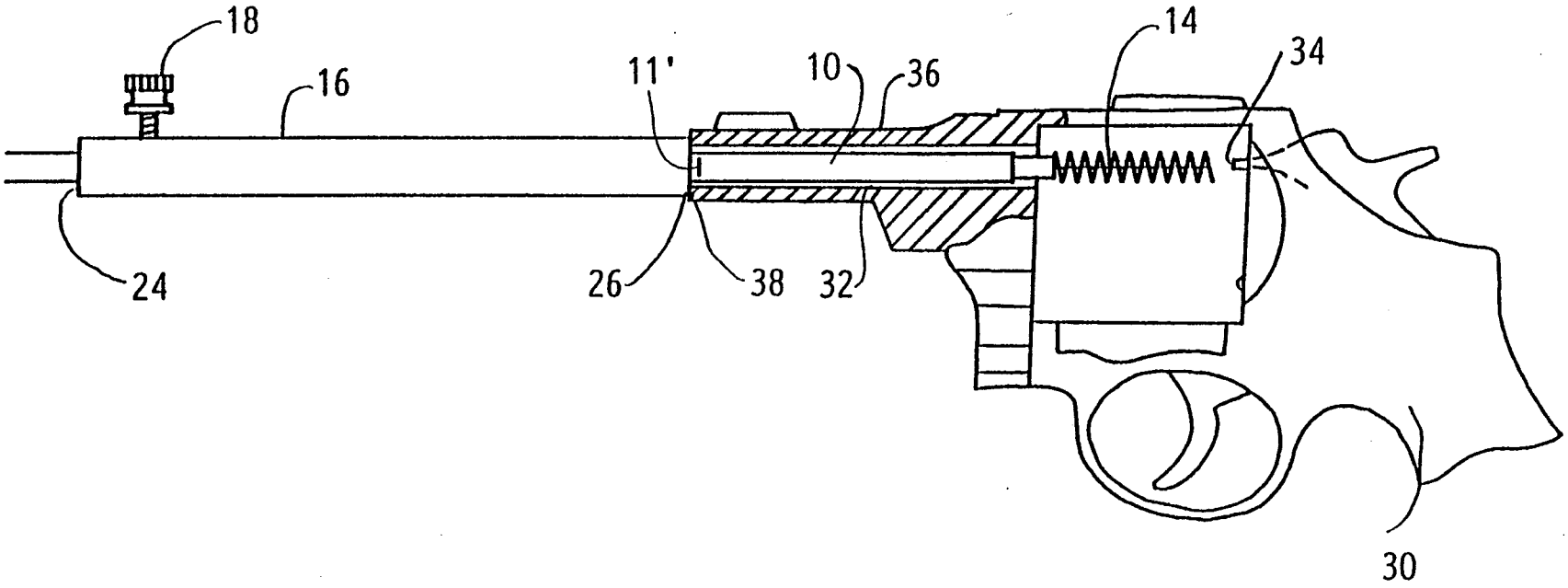
FIG. 4 is a cutaway view of the gun cleaning device being used for cleaning a snub nose revolver.

FIGS. 3 and 4 show the gun cleaning device being used for cleaning revolvers 30, in FIG. 3 a standard size revolver, and in FIG. 4 a snub nose revolver. For clarity, the barrel 36 of the revolver 30 is shown in a cutaway view.

At the beginning of the cleaning operation, the gun cleaning device will be in the storage position as shown in FIG. 2. The locking screw 18 should be loosened so that the handle 16 can be slid along the cleaning rod 10. The handle 16 should be positioned so that the distance from the shoulder stop 26 to the end of the wire brush 14 is slightly less than the distance from the end of the barrel 38 to the firing pin 34 of the revolver 30. This can be done by holding the device beside the revolver 30 for comparison or if the correct distance is known marks 11 and 11' can be scribed or printed on the rod 10 for repeated use. Once the correct effective length of the rod 10 is set, the locking screw 18 should be tightened to lock the handle 16 in place.

The wire brush 14 is inserted into the bore 32 of the gun barrel 36 and reciprocated to clean away any residue from firing the revolver 30. The forward motion of the rod 10 is limited when the shoulder 26 of the handle 16 contacts the end 38 of the gun barrel 36. This prevents the wire brush 14 from contacting the firing pin 34 and causing any damage or contamination.

When the bore 32 of the revolver 30 has been sufficiently cleaned, the wire brush 14 is withdrawn from the barrel 36. Then, a cleaning patch (not shown) is inserted into the patch holder 12 at the other end of the rod 10 and a few drops of oil are applied. The locking screw 18 is loosened and the handle 16 is moved along the rod until the distance from the second shoulder 24 to the end of the patch holder 12 is slightly less than the distance from the end 38 of the gun barrel 36 to the firing pin 34 of the revolver 30. The locking screw 18 is tightened to lock the handle 16 in place.

Then the patch holder 12 with the cleaning patch is inserted into the bore 32 of the revolver 30 and reciprocated to clean and oil the inside of the bore 32. The forward motion of the rod 10 is limited when the shoulder 24 contacts the end 38 of the gun barrel 36. This prevents the patch holder 12 and the cleaning patch from contacting the firing pin 34 and causing any damage or contamination. After the revolver 30 has been cleaned and oiled, the cleaning patch can be discarded and the device can be returned to the storage position with the wire brush 14 protected within the hollow cavity of the handle 16.

Thus, it can be seen that the gun cleaning device of the present invention provides sufficient protection to the firing pin of a gun that it can be used to safely clean a gun without disassembling or removing the firing mechanism. This is especially helpful for field cleaning of all guns and for cleaning of guns whose firing mechanisms are complex or difficult to disassemble.

Although the examples given include many specificities, they are intended as illustrative of only one of the possible embodiments of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

I claim:

1. A gun cleaning device, comprising:

a rigid rod having a first end and a second end, a wire brush attached to said first end of said rigid rod, a patch holding loop for holding a cleaning patch attached to said second end of said rigid rod, a coaxial cylindrical handle slidingly attached to said rigid rod intermediate said first end and said second end, said handle having a first end defining a first shoulder stop and a second end defining a second shoulder stop, said second end of said cylindrical handle having a coaxial through bore having a sliding fit with respect to said rigid rod, said second end of said cylindrical handle having a threaded transverse bore connecting with said through bore, a locking screw disposed within said threaded transverse bore, said first end of said cylindrical handle having a coaxial internal cavity, said internal cavity being axially connected with said through bore, said internal cavity having a length and a diameter of sufficient size to accommodate said wire brush inside said internal cavity, said gun cleaning device having at least three positions, including:

a brush-use position wherein said first end of said rigid rod is extended from said coaxial cylindrical handle such that said first shoulder stop delimits an effective working length of said first end of said rigid rod and said locking screw is tightened to lock said device in said brush-use position, a cleaning patch-use position wherein said second end of said rigid rod is extended from said coaxial cylindrical handle such that said second shoulder top delimits an effective working length of said second end of said rigid rod, and said locking screw is tightened to lock said device in said cleaning patch-use position, and a storage position wherein said internal cavity of said coaxial cylindrical handle is positioned such that it covers said wire brush, and said locking screw is tightened to lock said device in said storage position.

2. The gun cleaning device of claim 1 further comprising a first mark on said rigid rod for indicating the correct position of said rigid rod with respect to said coaxial cylindrical handle when said device is in said brush-use position, and a second mark on said rigid rod for indicating the correct position of said rigid rod with respect to said coaxial cylindrical handle when said device is in said cleaning patch-use position.

3. In combination:

a revolver, said revolver having a barrel and a firing pin, said revolver having a barrel length which is defined as the distance from said firing pin to the furthest end of said barrel, and a revolver cleaning device, said revolver cleaning device comprising:

a rigid rod having a first end and a second end, a wire brush attached to said first end of said rigid rod, a patch holding loop for holding a cleaning patch attached to said second end of said rigid rod, a coaxial cylindrical handle slidingly attached to said rigid rod intermediate said first end and said second end, said handle having a first end defining a first shoulder stop and a second end defining a second shoulder stop, said second end of said cylindrical handle having a coaxial through bore having a sliding fit with respect to said rigid rod, said second end of said cylindrical handle having a threaded transverse bore connecting with said through bore, a locking screw disposed within said threaded transverse bore, said first end of said cylindrical handle having a coaxial internal cavity, said internal cavity being axially connected with said through bore, said internal cavity having a length and a diameter of sufficient size to accommodate said wire brush inside said internal cavity, said revolver cleaning device having at least three positions, including:

a brush-use position wherein said first end of said rigid rod is extended from said coaxial cylindrical handle such that said first shoulder stop delimits an effective working length of said first end of said rigid rod and said wire brush, and said locking screw is tightened to lock said device in said brush-use position, said effective working length of said first end of said rigid rod and said wire brush being slightly less than said barrel length of said revolver so as to prevent contact between said wire brush and said firing pin of said revolver when said first end of said rigid rod and said wire brush are inserted into said barrel of said revolver, a cleaning patch-use position wherein said second end of said rigid rod is extended from said coaxial cylindrical handle such that said second shoulder stop delimits an effective working length of said second end of said rigid rod and said patch holding loop, and said locking screw is tightened to lock said device in said cleaning patch-use position, said effective working length of said second end of said rigid rod and said patch holding loop being slightly less than said barrel length of said revolver so as to prevent contact between said patch holding loop and said firing pin of said revolver when said first end of said rigid rod and said patch holding loop are inserted into said barrel of said revolver, and a storage position wherein said internal cavity of said coaxial cylindrical handle is positioned such that it covers said wire brush, and said locking screw is tightened to lock said device in said storage position.

4. The combination of claim 3 wherein said revolver cleaning device further comprises a first mark on said rigid rod for indicating the correct position of said rigid rod with respect to said coaxial cylindrical handle when said device is in said brush-use position, and a second mark on said rigid rod for indicating the correct position of said rigid rod with respect to said coaxial cylindrical handle when said device is in said cleaning patch-use position.

5. The combination of claim 3 further comprising a plurality of revolvers, each of said revolvers having a different barrel length, and wherein said revolver cleaning device further comprises a plurality of first marks on said rigid rod, each of said first marks indicating the correct position of said rigid rod with respect to said coaxial cylindrical handle when said device is in said brush-use position for a corresponding one of said revolvers, and a plurality of second marks on said rigid rod, each of said second marks indicating the correct position of said rigid rod with respect to said coaxial cylindrical handle when said device is in said cleaning patch-use position for a corresponding one of said revolvers.

* * * * *